US006491005B2

(12) United States Patent
Bergmann et al.

(10) Patent No.: US 6,491,005 B2
(45) Date of Patent: Dec. 10, 2002

(54) DIE CAST METAL CYLINDER ASSEMBLY FOR A TWO-STROKE ENGINE

(75) Inventors: Lars Bergmann, Welzheim (DE); Heiko Rosskamp, Adelberg (DE); Igor Klaric, Korb (DE); Michael Raffenberg, Fellbach (DE); Peter Pretzsch, Schorndorf (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 09/829,902

(22) Filed: Apr. 11, 2001

(65) Prior Publication Data

US 2001/0032602 A1 Oct. 25, 2001

(30) Foreign Application Priority Data

Apr. 22, 2000 (DE) ..... 100 19 983

(51) Int. Cl.[7] ..... F02B 33/00

(52) U.S. Cl. ..... 123/73 R; 123/73 PP; 123/65 P

(58) Field of Search ..... 123/73 R, 73 AV, 123/73 PP, 65 PE, 65 A, 65 V, 65 EM, 65 P, 195 R, 195 C

(56) References Cited

U.S. PATENT DOCUMENTS

| | | | | |
|---|---|---|---|---|
| 4,287,860 A | * | 9/1981 | Fujikawa et al. | 123/73 A |
| 4,306,522 A | * | 12/1981 | Fotsch | 123/65 PD |
| 5,025,760 A | * | 6/1991 | Webb et al. | 123/65 A |
| 5,947,066 A | | 9/1999 | Ishikawa | 123/65 P |
| 6,223,705 B1 | * | 5/2001 | Sato et al. | 123/65 P |
| 6,257,181 B1 | * | 7/2001 | Rosskamp et al. | 123/65 P |
| 6,267,088 B1 | * | 7/2001 | Rosskamp et al. | 123/65 P |
| 6,318,311 B1 | * | 11/2001 | Kikuchi | 123/193.6 |

* cited by examiner

*Primary Examiner*—Tony M. Argenbright
*Assistant Examiner*—Hai Huynh
(74) *Attorney, Agent, or Firm*—Walter Ottesen

(57) ABSTRACT

A cylinder is produced of die cast metal and is for a two-stroke engine in a portable handheld work apparatus such as a motor chain saw. A combustion chamber (3) is formed in the cylinder (2) and this combustion chamber is delimited by a piston (5). In the cylinder wall (16), there is an outlet (10) for conducting away the combustion gases from the combustion chamber (3). Transfer channels **(14*a*, 14*b*) are provided which open into the combustion chamber (3) via transfer windows (12, 15) and supply the operating medium from the crankcase (4) needed for operating the two-stroke engine. The transfer channels (14*a*, 14*b*) are configured in the cylinder wall (16) as channels opening radially to the outside and are closed by a seated cover (23)**.

11 Claims, 3 Drawing Sheets

DIE CAST METAL CYLINDER ASSEMBLY FOR A TWO-STROKE ENGINE

BACKGROUND OF THE INVENTION

A cylinder assembly for a two-stroke engine is known from U.S. Pat. No. 5,947,066 wherein the lateral transfer channels are configured in the cylinder wall as radial channels opening outwardly. The transfer channel of each side is closed radially to the outside by a cover. In this way, curved channels are formed which run curved to the cylindrical axis. If more than two transfer channels are on one side of a cylinder, then the manufacture in die cast is no longer possible because of the different angles and channel paths.

SUMMARY OF THE INVENTION

It is an object of the invention to provide a die cast metal cylinder assembly for a two-stroke engine which makes two and more transfer channels possible on opposite-lying sides. The cylinder assembly of the invention is for a two-stroke engine including an engine for a portable handheld work apparatus including a chain saw, brushcutter, cutoff machine or the like. The two-stroke engine includes a piston. The cylinder assembly includes: a cylinder having a cylinder wall defining a cylinder bore surface and a cylinder axis; the cylinder wall and the piston conjointly delimiting a combustion chamber in the engine; an outlet formed in the cylinder wall for conducting combustion gases away from the combustion chamber; a plurality of transfer channels for conducting operating means to the combustion chamber for operating the engine; a first one of the transfer channels having a first transfer window opening into the combustion chamber near the outlet to form an outlet-near transfer window; a second one of the transfer channels having a second transfer window opening into the combustion chamber remote from the outlet to form an outlet-remote transfer window; the first and second transfer channels being open channels directed radially outwardly; a cover mounted on the cylinder to cover the channels; the first and second windows having respective outlet-remote frame surfaces extending approximately parallel to the cylinder axis and facing toward the outlet viewed in the peripheral direction of the cylinder bore surface; and, the outlet-remote frame surfaces lying in respective mutually parallel pull planes.

The alignment of the transfer channels and the transfer channel windows to the combustion chamber is such that the inflow direction of the inflowing gases is different. The different inflow direction causes different angles of the channel side walls. According to the invention, the frame surfaces of the outlet-near and outlet-remote transfer windows on one side are arranged in pull planes parallel to each other. The frame surfaces run approximately parallel to the cylinder axis and lie facing toward the outlet in the peripheral direction of the cylinder bore. For this reason, the possibility is provided to form the two transfer windows, which lie on one side, with core sliders movable radially from the outside without backcuts, projections or the like. The core sliders can be moved individually or together in mutually parallel pull planes. The axial opening of the transfer channels to the crankcase is provided by axial core sliders which are to be moved in the direction of the cylinder axis.

The core sliders forming the transfer windows are so configured that they simultaneously form the outer frame surfaces of the transfer windows together with the external channel side walls.

In order to configure the different inflow directions, it is provided that the frame surfaces of a transfer window, which run approximately in the longitudinal direction of the cylinder axis, lie in planes which intersect in the combustion chamber. The intersect angle of the planes of the first outlet-near transfer channel window is greater, preferably by 0.2 to 0.5 times greater, than the intersect angle of the planes of the second outlet-remote transfer window.

The frame surface of the first, outlet-near transfer window lies facing toward the outlet and extends with a step to the channel center wall configured in the cover. In this way, the edge of the frame surface (which lies facing toward the outlet) of the first transfer window is so arranged that it lies on the inner surface of the cylinder bore as well as in the plane of a side surface (formed by the channel center wall) of the outlet-near transfer channel. This edge of the frame surface of the first transfer window runs along the cylinder axis and faces toward the combustion chamber.

A recess, notch or the like in the material of the cylinder is advantageously provided between the outlet-near transfer channel and the outlet. This is provided in order to avoid an increased thermal transfer from the outlet to the outlet-near transfer channel.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
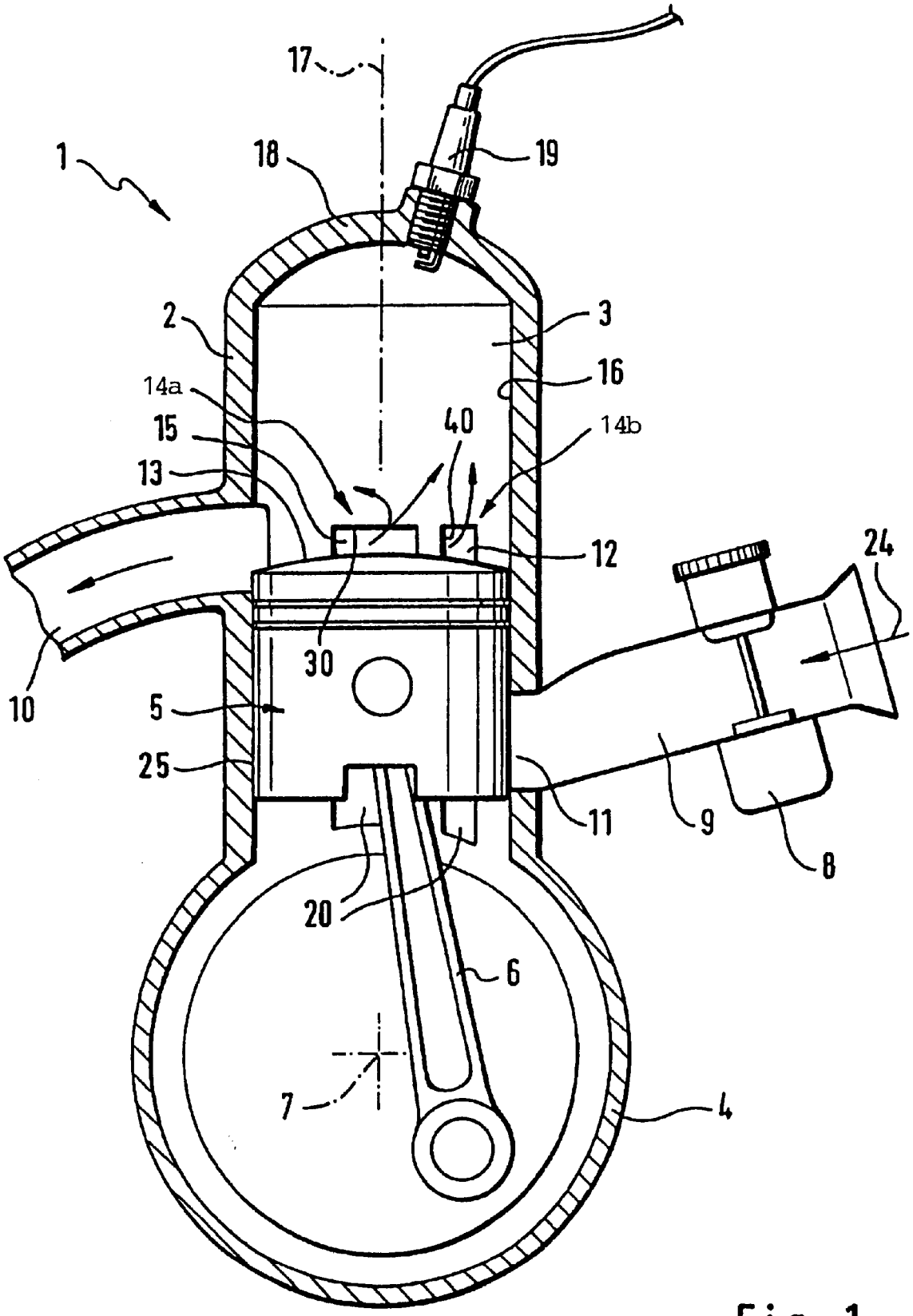
FIG. 1 is a schematic section view taken through a two-stroke engine having transfer channels lying on opposite sides of the cylinder.

The two-stroke engine 1 shown schematically in FIG. 1 is preferably utilized as a drive engine in a portable handheld work apparatus such as a motor chain saw, cutoff machine, brushcutter, blower or the like. The two-stroke engine 1 comprises essentially a cylinder 2 in which a combustion chamber 3 is formed. The combustion chamber 3 is delimited by the base 13 of a piston 5 moving upwardly and downwardly on the one hand and by a cylinder head 18 on the other hand. A spark plug 19 for igniting the air/fuel mixture compressed in the combustion chamber 3 is provided in the cylinder head 18.

The piston 5 moves upwardly and downwardly in the cylinder bore and drives a crankshaft 7 via a connecting rod 6. The crankshaft 7 is rotatably journalled in a crankcase 4.

Openings are provided in the cylinder wall 16 and these openings are controlled by the piston 5 or the piston skirt 25. Combustion air 24 flows in via an inlet 11 lying close to the crankcase 4. The combustion air 24 is enriched with fuel in a mixture preparation device 8 and flows into the crankcase 4 via the inlet channel 9 and the inlet 11. In the embodiment shown, the inlet 11 is controllable exclusively by the piston skirt 25. The inlet 11 is completely closed in the stroke position of the piston 5 shown in FIG. 1. The air/fuel mixture inducted into the crankcase 4 is compressed with a further downward movement of the piston 5 in the direction toward bottom dead center and is moved out of the crankcase 4 into the combustion chamber 3 via transfer channels (14*a*, 14*b*).

In the following upward movement of the piston 5, the transferred mixture is compressed in the combustion chamber 3 and is ignited by the spark plug 19 for a next work stroke. In the downward travel of the piston 5, first an outlet 10 provided in the cylinder wall 16 is opened via which the hot combustion gases can flow away. Thereafter, transfer windows (12, 15) open to permit a fresh mixture inflow from the crankcase 4 via transfer channels (14*a*, 14*b*).

The first outlet-near transfer channel 14*a* opens via a transfer window 15 into the combustion chamber 3. This first transfer window 15 lies close to the outlet 10 and is configured in the cylinder wall 16. A second outlet-remote transfer channel 14*b* opens via a second transfer window 12 into the combustion chamber 3 remote from the outlet 10. The second transfer window 12 is provided in the cylinder wall 16.

In the embodiment of FIG. 1, both transfer channels (14*a*, 14*b*) are axially open at their ends 20 facing toward the crankcase 4 so that the air/fuel mixture can be pumped via the two transfer channels 20 into the combustion chamber 3. The air/fuel mixture is inducted into the crankcase via the inlet channel 9. It can be practical to supply exclusively pure air through the outlet-near transfer channels 14*a* and to supply the mixture via the outlet-remote transfer channels 14*b*. An engine of this kind would be a stratified charge engine. If it is preferred to prestore fuel-free air in the outlet-near transfer channel 14*a*, the engine can be operated as a scavenging engine. For the sake of simplicity, the different switching of the outlet-near and outlet-remote transfer channels (14*a*, 14*b*) is not shown in greater detail.

Figure 2:
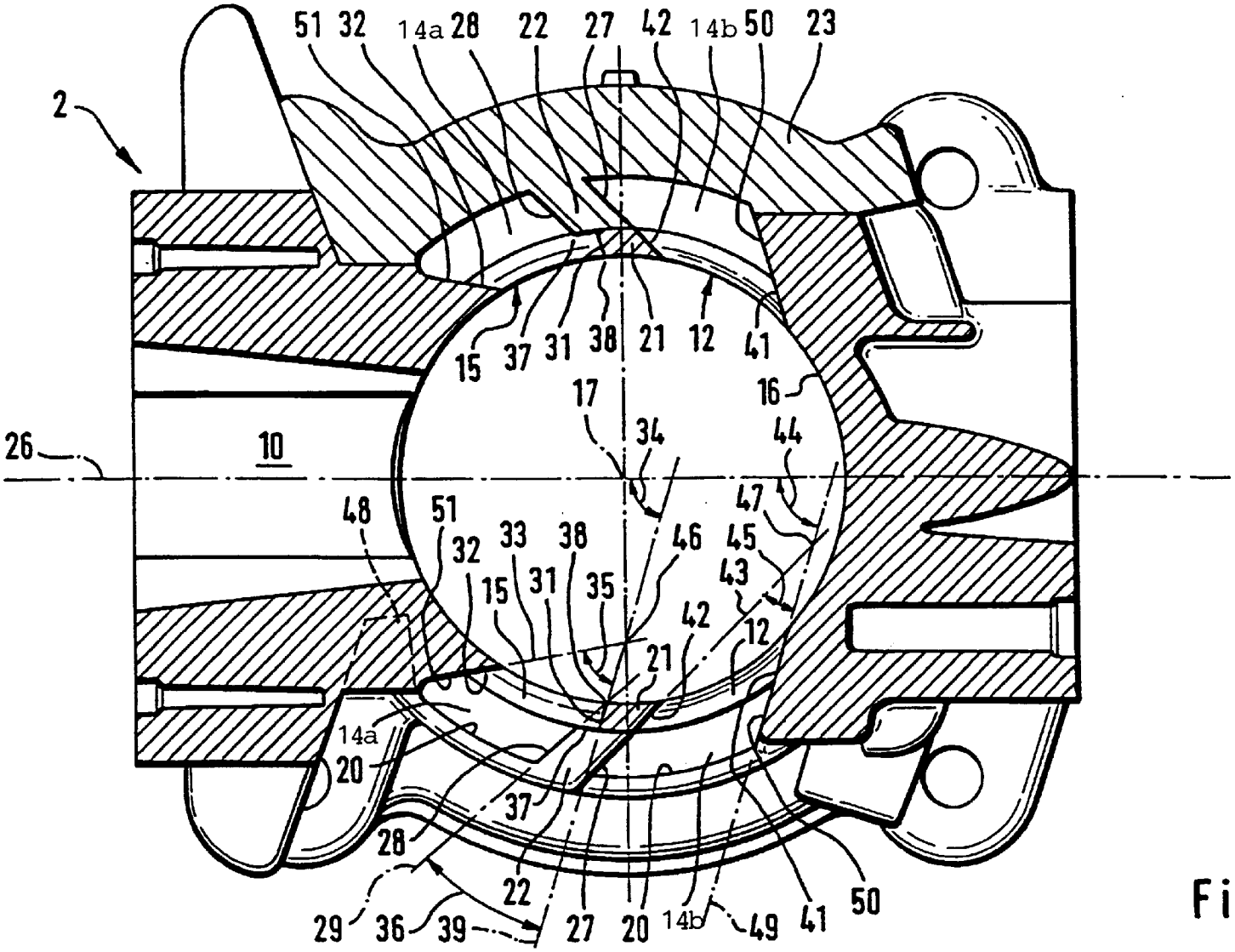
FIG. 2 is a section view taken along line II—II of FIG. 1.
Figure 3:
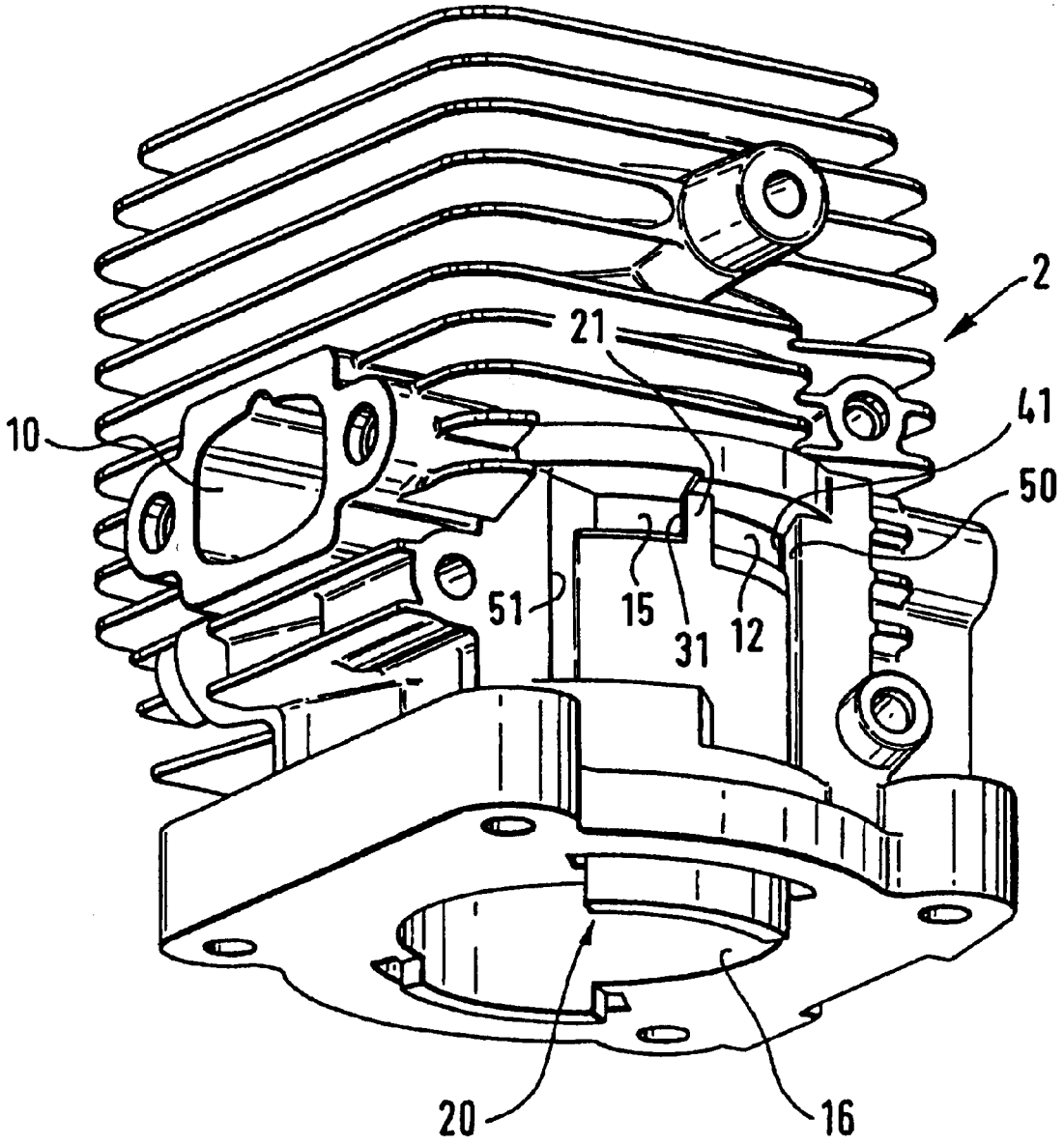
FIG. 3 is a perspective view directed to the transfer channels of the cylinder with the cover removed and the transfer channels opening radially toward the outside.

To be able to manufacture the cylinder 2 of the two-stroke engine 1 as a die cast metal part, the transfer channels (14*a*, 14*b*) are configured as channels opening radially outwardly which are closed by a radially seated cover 23 shown in FIG. 2. The cover 23 carries a channel center wall 22 which extends over the axial length of the transfer channels and partitions the outlet-near transfer channel 14*a* from the outlet-remote transfer channel 14*b*. With the cover removed as shown in FIG. 3, the channels are substantially completely open radially outwardly. only the center strut 21 between the transfer windows 15 and 20 as well as the transfer windows themselves can be seen.

In the cylinder wall 16, each transfer window 12 and 15 is delimited by a frame 30 and 40. The frame has frame surfaces (31, 32 or 41, 42) running approximately parallel to the cylinder axis 17.

The frame surface 31 of the transfer window 15 as well as the frame surface 41 of the transfer window 12 lie in mutually parallel planes 39 and 49. The frame surface 31 of the transfer window 15 lies the farthest from the outlet 10 and the frame surface 41 of transfer window 12 lies farthest from the outlet 10. These mutually parallel planes 39 and 49 of the surfaces 31 and 41 of the transfer windows 15 and 12 define pull planes for sliders of a die cast form. Frame surfaces 31 and 41 lie facing toward the outlet 10. The frame surface 31 of the transfer window 15 is formed on the center strut 21 between the transfer windows and is configured to lie precisely parallel to the frame surface 41 of the transfer window 12 so that the sliders, which form the transfer windows 12 and 15, can be moved in and out without disturbance in the direction of the pull planes 39 and 49. The frame surface 41 of the outlet-remote transfer window 12 lies in a plane with the channel side wall 50 of the outlet-remote transfer channel 14*b*. The channel side wall 51 and the frame surfaces 41 lie together in the pull plane 49.

The pull plane 39 intersects the longitudinal center axis 26 of the outlet 10 at an angle 34 open to the outlet 10. The pull plane 49 intersects the longitudinal center axis 26 of the outlet 10 at an angle 44 open to the outlet 10. The angles 34 and 44 are preferably less than 90°. In the embodiment shown, each of the angles 34 and 44 has a magnitude of approximately 70° to 80°.

The frame surfaces 31 and 32 of the frame 30 of the transfer window 15 lie opposite each other but are not parallel to each other. The frame surfaces 41 and 42 of the frame 40 of the transfer window 12 lie opposite to each other and are also not parallel to each other. The frame surface 32 of the transfer window 15 lies facing away from the outlet 10 and defines a plane 33 which intersects the pull plane 39 of the frame surface 31 at an angle 35, which is open to the transfer window 15 and is less than 90°. In the embodiment shown, the angle 35 is approximately 60°.

In the same way, the frame surface 42 of the transfer window 12 defines a plane 43 which intersects the pull plane 49 at an angle 45 which is approximately 30° in the embodiment shown. The frame surface 42 lies facing away from the outlet 10. The intersect line 46 of the planes 33 and 39 and the intersect line 47 of the planes 43 and 49 lie close to the cylinder wall 16 in the combustion chamber and lie preferably approximately parallel to the cylinder axis 17.

The frame surface 32 of the outlet-near transfer window 15 lies with channel side wall 51 in common in plane 33. In the same manner, the frame surface 42 of the outlet-remote transfer window 12 lies in a plane 43 with the side surface 27 of the channel center wall 22 formed in the cover 23. The frame surface 42 faces away from the outlet 10.

In a departure from this configuration, the frame surface 31 of the outlet-near transfer window 15 lies at an angle 36 to the assigned side wall 28 of the channel center wall 22. The frame surface 31 faces toward the outlet 10. The plane 29, which is determined by the side wall 28, intersects the pull plane 39 at an angle 36, which is open to the cover 23. In the embodiment shown, the angle 36 is approximately 30°. A step 37 lies facing toward the transfer window 15 and is formed between the center strut 21 and the channel center wall 22 in the cover 23.

The arrangement is so configured that the edge 38 of the frame surface 31 lies precisely in the plane 29 and the cylinder interior wall. The plane 29 is defined by the side wall 28 of the channel center wall 22. In this way, a negative effect on the flow, which enters into the combustion chamber by the step 37, is substantially precluded.

In a further embodiment of the invention, a recess, notch or the like 48 is provided between the outlet-near transfer window 15 or the outlet-near transfer channel 14*a* and the outlet stub of the cylinder 2 extending from the outlet 10. With this recess, which is formed by a corresponding projection of the slider, it is intended that the thermal transfer between the outlet 10 and the outlet-near transfer channel 14*a* is reduced. In this way, a temperature reduction in the region of the transfer channel 14*a* is obtained which leads to an improved charge of the combustion chamber.

It is understood that the foregoing description is that of the preferred embodiments of the invention and that various changes and modifications may be made thereto without departing from the spirit and scope of the invention as defined in the appended claims.

What is claimed is:

1. A cylinder assembly for a two-stroke engine including an engine for a portable handheld work apparatus including a chain saw, brushcutter and cutoff machine, the two-stroke engine including a piston, the cylinder assembly comprising:

a cylinder having a cylinder wall defining a cylinder bore surface and a cylinder axis;

said cylinder wall and said piston conjointly delimiting a combustion chamber in said engine;

an outlet formed in said cylinder wall for conducting combustion gases away from said combustion chamber;

a plurality of transfer channels for conducting operating means to said combustion chamber for operating said engine;

a first one of said transfer channels having a first transfer window opening into said combustion chamber near said outlet to form an outlet-near transfer window;

a second one of said transfer channels having a second transfer window opening into said combustion chamber remote from said outlet to form an outlet-remote transfer window;

said first and second transfer channels being open channels directed radially outwardly;

a cover mounted on said cylinder to cover said channels;

said first and second windows having respective outlet-remote frame surfaces extending approximately parallel to said cylinder axis and facing toward said outlet viewed in the peripheral direction of said cylinder bore surface;

said outlet-remote frame surfaces lying in respective mutually parallel pull planes;

said first transfer window also having an outlet-near frame surface;

said outlet-near and said outlet-remote frame surfaces of said first transfer window lying in respective first planes which intersect in said combustion chamber;

said second transfer window also having an outlet-near frame surface; and, said outlet-near and said outlet-remote frame surfaces of said second transfer window lying in respective second planes which also intersect in said combustion chamber.

2. The cylinder assembly of claim 1, wherein the frame of said first transfer window has an outlet-near frame surface facing away from said outlet and lying in a plane with an outer side wall of said first transfer channel; and, wherein said outlet-remote frame surface of said second transfer window lies in a plane with an outer side wall of said second transfer channel.

3. The cylinder assembly of claim 1, wherein said first planes conjointly define a first intersect angle; said second planes conjointly define a second intersect angle; and, said first intersect angle is greater than said second intersect angle.

4. The cylinder assembly of claim 3, said first intersect angle being greater than said second intersect angle by a factor of approximately 0.2 to 0.5.

5. The cylinder assembly of claim 3, wherein said outlet defines a longitudinal center axis; one of said first planes is a first pull plane and one of said second planes is a second pull plane; and, said first and second pull planes intersect said longitudinal center axis at an angle of less than 90° and face toward said outlet.

6. The cylinder assembly of claim 1, wherein said first transfer window has an outlet-remote frame surface facing toward said outlet and defining a plane; said cover has a channel center wall defining a side wall of said first transfer channel; and, said plane and said side wall conjointly define an angle of less than 90° open to said cover.

7. The cylinder assembly of claim 6, said angle being in a range of approximately 20° to 40°.

8. The cylinder assembly of claim 1, wherein said cover has a channel center wall; and, said first transfer window has an outlet-remote frame surface facing toward said outlet and said outlet-remote frame surface extends to said channel center wall with a step.

9. The cylinder assembly of claim 1, wherein said cylinder has an outlet stub formed thereon and said outlet stub extends from said outlet; and, said cylinder has a recess formed in the material thereof between said outlet-near transfer window and said outlet stub.

10. The cylinder assembly of claim 1, wherein said first transfer window has an outlet-remote frame surface facing toward said outlet; said frame surface defines an edge facing toward said combustion chamber and extending in the direction of said cylinder axis; said cover has a channel center wall defining a side wall of said first transfer channel; and, said side wall defines a plane containing said edge.

11. The cylinder assembly of claim 10, wherein said edge lies on said cylinder bore surface.

* * * * *